US007464418B2

(12) United States Patent
Seggio et al.

(10) Patent No.: US 7,464,418 B2
(45) Date of Patent: Dec. 16, 2008

(54) PROXIMITY FAUCET HAVING SELECTIVE AUTOMATIC AND MANUAL MODES

(75) Inventors: Frank A. Seggio, Wayside, NJ (US); David J. Meisner, Monmouth Beach, NJ (US); Robert C. Kass, Skillman, NJ (US)

(73) Assignee: Ideal Standard International BVBA, Brussels (BE)

( * ) Notice: Subject to any disclaimer, the term of this patent is extended or adjusted under 35 U.S.C. 154(b) by 0 days.

(21) Appl. No.: 11/795,209

(22) PCT Filed: Dec. 22, 2005

(86) PCT No.: PCT/US2005/046871

§ 371 (c)(1),
(2), (4) Date: Oct. 9, 2007

(87) PCT Pub. No.: WO2006/076149

PCT Pub. Date: Jul. 20, 2006

(65) Prior Publication Data

US 2008/0189850 A1 Aug. 14, 2008

(51) Int. Cl.
*E03C 1/05* (2006.01)

(52) U.S. Cl. ..... 4/623; 251/129.04

(58) Field of Classification Search ..... 4/623, 4/675–678, 302–305; 251/129.03, 129.04
See application file for complete search history.

(56) References Cited

U.S. PATENT DOCUMENTS 5,819,336 A * 10/1998 Gilliam et al. ..... 4/623
7,014,166 B1 * 3/2006 Wang ..... 4/623

* cited by examiner

*Primary Examiner*—Tuan N Nguyen
(74) *Attorney, Agent, or Firm*—Matthew K. Ryan; Frommer Lawrence & Haug LLP

(57) ABSTRACT

A proximity faucet is provided that includes a housing, faucet and lever support portions and a peripheral housing wall with a spout portion having a neck extending outward from the housing wall and a fluid outlet at a free extent thereof. The faucet support portion accommodates an elongate shank extending downwardly therefrom and having at least one fluid supply conduit therein. The lever support portion receives a mixing cartridge therein that mixes cold and hot water delivered by the fluid supply conduit. The lever support portion supports a freely rotatable lever thereon. The lever is coupled to the mixing cartridge such that rotation of the lever adjusts the water temperature and flow rate. A sensor cover ring that is rotatably disposed adjacent the housing wall includes a reflective surface along an inner surface thereof that lies adjacent the housing wall. The sensor cover ring includes an eye that aligns with a proximity detector disposed in the housing wall and permits the proximity detector to emit a signal therefrom. The proximity detector, which is in electrical communication with an electronically controlled valve that is positioned downstream of the mixing cartridge, transmits a signal to the electronically controlled valve upon sensing am object or upon concealment of the proximity detector by the sensor cover ring, thereby maintaining the mixing cartridge in an open position. The proximity detector is correspondingly rotatable with the spout portion as the spout portion rotates relative to a receptacle proximate which the faucet is used. A proximity filter faucet having selective automatic and manual modes is also disclosed.

15 Claims, 4 Drawing Sheets

PROXIMITY FAUCET HAVING SELECTIVE AUTOMATIC AND MANUAL MODES

FIELD OF THE INVENTION

The present invention is directed to fluid delivery devices for use in sanitary applications and having automatic and manual modes of operation. In particular, the present invention is directed to a proximity faucet that facilitates immediate selection between automatically controlled continuous water delivery and user-controlled manual water delivery as desired.

BACKGROUND OF THE INVENTION

For over a century, skin hygiene, particularly of the hands, has been accepted as a primary mechanism for reducing contact with and fecal-oral transmission of infectious agents (see "Hygiene of the Skin: When is Clean Too Clean", Elaine Larson, Emerging Infectious Diseases, Vol. 7, No. 2, March-April 2001, www.cdc.gov/ncidod/eid/vol7no2/larson.htm). Most prominent health organizations advocate the benefits of handwashing for the prevention of infectious agents found transiently on the hands or spread by the fecal-oral route or from the respiratory tract. The United States Food and Drug Administration (FDA), for instance, mandates the personal cleanliness of food employees who prepare and serve meals in restaurants, grocery stores and other venues. The FDA Model Food Code requires food employees to follow a prescribed cleaning regimen, including vigorous cleaning of the hands and exposed forearms immediately prior to and during food preparation as often as necessary to prevent cross contamination (see FDA 2001 Food Code—Chapter 2: Management and Personnel, Section 2-3).

Recognizing the established relationship between transmission of infectious pathogens and personal sanitation, many sanitary manufacturers have introduced sensor-activated fluid delivery devices that reduce user contact with the devices and the consequent transmission of deleterious pathogens. Many "touchless" sanitary devices exist (i.e., faucets, toilets and urinals) that employ sensors to detect a user's presence and dispense water in accordance with one or more preprogrammed variables, including but not limited to the anticipated frequency of operation, the duration of use and the volume of water needed for sufficient cleanliness. Upon detecting the user's presence, the sensors compare the conditions of use with the preprogrammed variables and transmit corresponding signals to one or more valves in electrical communication therewith. The signals open and close the valves accordingly to adjust the water volume, temperature and flow rate without manual adjustment by the user. Sensor-activated sanitary devices therefore reduce opportunities for cross contamination by promoting hands-free operation.

Automatic faucets are particularly prominent in professional, residential and commercial installations. Health care institutions (such as hospitals, clinics and doctors' offices), restaurants, caterers and individual homeowners have installed automatic faucets as a way to achieve hand sanitation with minimal faucet contact. Automatic faucets have been especially useful in residential and commercial kitchens in which multiple tasks inherent in proper food preparation promote cross contamination. Automatic faucets are also particularly prominent in hospitals and other health care facilities in which health care workers assisting multiple patients in a short time span regularly spread infection among patients and among themselves due to insufficient hand washing.

Conventional touchless faucets, however, have suffered several drawbacks. Upon their introduction, many faucets did not enable easy adjustment of water volume, temperature and/or flow rate, and most did not provide selection between automatic and manual modes. Several manufacturers have sought to overcome such drawbacks.

U.S. Pat. No. 4,604,764 discloses a fluid delivery system that can be manually or automatically controlled. The delivery system includes a body for directing fluid, a regulator that manually controls fluid flow though the body and a setscrew for releasably locking the regulator in an open position for continuous fluid flow. An electrically operated valve is provided that includes each of an automatically controlled circuit and a manually controlled circuit. A sensor coupled to the valve detects the presence of a user and produces a signal in response thereto. The sensor transmits the signal to a controller for opening and closing the valve accordingly. The setscrew is engaged when the manually controlled fluid flow circuit is closed, and the setscrew is released when the manually controlled fluid flow circuit is open. A key, screwdriver or similar implement may open the circuit.

U.S. Pat. No. 4,709,728 discloses a single-axis control automatic faucet having a manually actuatable valve, a solenoid valve and an infrared sensor for opening the solenoid valve upon detection of a user's hands. The faucet controls the release of water and further adjusts the water temperature via manual operation of a single-axis stem switch. In the event of a power interruption, automatic operation can be changed to manual operation by depressing the switch. Depression of the switch lowers a control stem and opens a valve port from which water is discharged continuously. Under this condition, unless the switch is manually pulled so as to close the valve port, water will flow continuously from the faucet. When power is supplied, depression of the switch enables automatic operation upon passage of a user's hand in proximity of the sensor. Upon removing the hand, the switch must be pulled up manually to fully close the valve port.

U.S. Pat. No. 4,962,790 discloses a faucet having interchangeable proximity actuation control and hand control for water flow. The faucet includes a hemispherical valve seat with two holes and two channels formed therein. A valve stem guide is provided that has an H-shaped guide groove formed therein to accommodate passage of a valve stem that is coupled to a handle. A bi-directional feed pipe has one end connected to a valve outlet hole that is opened or closed by a solenoid valve in electrical communication therewith. A second end of the feed pipe connects with a channel on the valve seat, and a pipe juncture formed on the feed pipe is connected with an outlet pipe. A sensor in electrical communication with the solenoid valve effects operation of the valve upon detection of a user within proximity of the sensor. The user turns the handle to match cold and hot water outlet channels with hot and cold water inlet holes so that the desired water temperature flows from the faucet upon the sensor's detection of the user. The user adjusts the water temperature by turning the handle clockwise or counterclockwise.

U.S. Pat. No. 5,351,347 discloses a proximity-controlled sanitary fitting having an electrically controlled valve body and an electric proximity detector in electrical communication therewith. The detector comprises a radiation-emitting transmitter that sends signals to a receiver. A sensor detects at least one of a user and a water level, produces an output control signal in correspondence therewith and transmits such signal to the valve. A manually operated handle that is operatively coupled to a switch controls operation of the proximity detector. The handle, which extends outwardly from a main body having a spout, is manually adjustable among a first position, in which the detector senses a user and provides an output signal to the valve; a second position, in which the valve is closed to prevent water flow; and a third position, in which the detector does not sense a user's presence and maintains the valve in an open position to permit continuous water flow. This configuration enables detection of the water volume in a wash basin and consequent cessation of water flow when a predetermined volume is attained.

Related U.S. Pat. Nos. 5,358,213, 5,397,099, 5,595,216 and 5,755,262 disclose a faucet having automatic and manual control capability. The disclosed faucet includes a body supporting a single flow control valve with a chamber defined therewithin and at least one inlet port and at least one outlet port. The valve further includes a positionable valve member that moves between a closed position, wherein the inlet and outlet ports are isolated from the chamber, and an open position, wherein the inlet and outlet ports are in open communication with the chamber. Each of a manual actuation mechanism (i.e., an operating lever) and an electrically operated automatic actuation mechanism (i.e., a solenoid) is coupled with the valve member for movement thereof, such that the automatic mechanism moves the valve member independent of the manual mechanism. A sink arrangement is also shown in which the disclosed faucet is positioned over each bowl of a sink. A detector is provided to ensure the discharge of the proper water volume in a selected bowl.

U.S. Pat. No. 6,003,170 discloses a single-lever faucet assembly having a conduit defining a flow path between a water supply and an outlet. Each of a mechanical valve and a servo-valve is disposed in the conduit. A lever coupled to the mechanical valve moves the mechanical valve between open and closed positions. A proximity detector is also provided in electrical communication with a controller that is also coupled to the servo-valve. Upon detection of an object in its proximity, the detector transmits a signal to open the servo-valve. A position-detecting switch in communication with the mechanical valve and the controller maintains activation of the controller upon shifting of the mechanical valve into its open position and deactivation of the controller upon shifting of the mechanical valve into its closed position. In this configuration, as soon as a user touches the handle is touched, the controller opens the solenoid valve and starts monitoring the sensor. The faucet therefore operates like a standard faucet except that it will turn itself off after a predetermined duration if no contact is made with the handle. To restore fluid flow, the user touches the handle, such that the proximity detector only shuts the water off when the faucet is not in use.

U.S. Pat. No. 6,044,865 discloses a single-lever mixer having a housing part with a mixer tap disposed therein. A control rod that is coupled to an actuating lever effects actuation of the mixer tap between a final closed position and a final open position. An electrically controllable valve is fitted downstream of the mixer tap and is electrically coupled to a proximity sensor. The actuating lever manually controls the electrical valve through a lever arrangement coupled between the control rod and the electrical valve. Adjustment is achieved such that in the mixer tap's final closed position (or within a first pivot range of the actuating lever), the valve remains closed; in the mixer tap's final open position (or within a third pivot range of the lever), the valve remains open; and within a second pivot range of the actuating lever, the valve remains closed and is opened only by activation of the proximity sensor.

U.S. Pat. No. 6,341,389 discloses a faucet assembly having a housing with an outlet and a servovalve disposed in a conduit that defines a flow path from a water supply through the housing to the outlet. A manual valve that is also disposed in the conduit has a control element movable among open, intermediate and closed positions. A position detecting switch subassembly mounted on the housing engages the control element, and a proximity detector is provided that has a detection field adjacent the outlet. A controller coupled to the proximity detector, the switch subassembly and the servovalve deactivates the detector and closes the servovalve when the control element is in the closed position. When the control element is in the intermediate position, the controller opens the servovalve upon sensing a user in the detection field. When the control element is in the open position, the controller disables the detector and opens the servovalve thereby.

U.S. Pat. No. 6,363,549 discloses a faucet system including a manually controlled valve having a handle for controlling fluid flow between an inlet and an outlet. The faucet also includes an electrically controlled valve hydraulically in series with the manual valve. A first sensor is provided that detects a user's presence in the vicinity of the manual valve, and a second sensor is provided that detects user contact with the handle. An electronic controller is coupled to the electrical valve and the first and second sensors such that the second sensor is hierarchically superordinate to the first sensor, thereby keeping the electrical valve open as long as there is contact with the handle. The first sensor is hierarchically subordinate to the second sensor, thereby keeping the electrical valve open in the absence of handle contact and with continuous activation of the first sensor.

U.S. Pat. No. 6,390,125 discloses a faucet valve system having a lever-operated valve with a housing formed with a water outlet. At least one water inlet communicates with the housing, and a valve member is disposed in the housing between the inlet and the outlet. A control lever is provided that is movable about an axis transverse to the housing's central axis. A detent member in the housing is formed with a detent opening along an arcuate path of the lever. The detent member includes a spring-loaded detent body bearing thereon that engages in the detent opening upon displacement of the lever about its pivot axis to a predetermined angular position for opening the valve member. An electric circuit is provided that responds to the angular displacement and includes at least one further valve in series with the lever-operated valve for controlling fluid flow from the outlet. The further valve has a control coupled to a detector that maintains the further valve open for a duration determined by activation of the detector. A switch in the housing is connected with the control for rendering the detector effective in the lever's predetermined angular position and rendering the detector ineffective in other angular positions.

None of these improvements in touchless technology discloses a fluid delivery device that eliminates contact with the device in an automatic mode, yet still delivers water having desired temperature, volume and fluid flow characteristics. At installations where automatic faucets are prevalent (such as restaurants and health care facilities), extensive research has revealed that professionals in those facilities actually wash their hands for a shorter period of time than required by prevailing health codes. Such individuals cite the faucets' inability to provide water flow at a predictable temperature, volume and flow rate, as well as significant time lapses between placement of the user's hands in a sensor's detection zone and initial water flow onto the hands. These conventional faucets incur delays in the professionals' schedules and deliver water at uncomfortable temperatures and pressures. These professionals do not have extra time between tasks for adjusting water flow conditions, and in many cases, the faucet is not amenable to such changes without faucet contact. Faucet contact and delays in water delivery encourage these professionals to reduce handwashing duration or eliminate washing altogether, thereby obviating any hygienic benefit provided by the automatic nature of the faucet.

It is therefore desirable to provide a selectively operable proximity faucet that overcomes the above-cited shortcomings. It is further desirable to provide such a faucet that permits easy selection between fully manual and fully automatic modes without adjustment of the proximity detector and without hand contact on any portion of the faucet while in the automatic mode.

SUMMARY OF THE INVENTION

It is an advantage of the present invention to provide a proximity faucet that enables easy selection between automatic and manual operation thereof.

It is also an advantage of the present invention to provide a proximity faucet that permits completely touchless automatic operation.

It is another advantage of the present invention to provide a proximity faucet that immediately delivers water upon sensing the presence of a user's hands.

It is further an advantage of the present invention to provide a proximity faucet that is useful in a variety of embodiments, including, but not limited to, combination faucet and filter faucet configurations.

In accordance with these and other advantages, the present invention provides a fluid delivery device that can selectively operate as a conventional faucet or an automatic electronic sensor faucet. In particular, the present invention provides a proximity faucet that includes a housing, faucet and lever support portions and a peripheral housing wall with a spout portion having a neck extending outward from the housing wall and a fluid outlet at a free extent thereof. The faucet support portion accommodates an elongate shank extending downwardly therefrom and having at least one fluid supply conduit therein. The lever support portion receives a mixing cartridge therein that mixes cold and hot water delivered by the fluid supply conduit. A freely rotatable lever is supported on the lever support portion and is coupled to the mixing cartridge such that rotation of the lever adjusts the water temperature and flow rate. A sensor cover ring that is rotatably disposed adjacent the housing wall has a reflective surface along an inner surface thereof that lies adjacent the housing wall. The sensor cover ring includes an eye that aligns with a proximity detector disposed in the housing wall and permits the proximity detector to emit a signal therefrom. The proximity detector is in electrical communication with an electronically controlled solenoid valve that is positioned downstream of the mixing cartridge. The proximity detector transmits a signal to the solenoid valve upon sensing a user's presence, or upon concealment of the proximity detector by the sensor cover ring, thereby maintaining the mixing cartridge in an open position.

The housing itself may be rotatable about the housing's longitudinal axis so that the faucet may be positioned relative to a receptacle proximate which the faucet operates (for instance, a sink, tub or basin). Upon rotation of the housing, the proximity detector and the sensor cover ring rotate correspondingly with the housing such that the sensor cover ring remains rotatable relative to the housing wall. This configuration defines a predictable detection zone that follows the path of rotation of the housing. It is also within the scope of the present invention to fix the proximity detector so as to create a detection zone that does not move with spout.

The position of the sensor cover ring determines selection between the automatic and manual functions. A closed cover (that is, rotation of the sensor cover ring to conceal the proximity detector) inhibits transmission of a signal from the proximity detector and maintains the solenoid valve in an open position. The user can thereby manipulate the lever about its axes of rotation to manually adjust the temperature, volume and flow rate of water discharged from the spout. With an open cover (that is, rotatable alignment of the eye with the proximity detector), the solenoid valve is normally closed and opens only when the proximity detector senses an object in its detection zone. A single solenoid valve is mounted between the manual valve and the spout, although a solenoid valve may be mounted on each individual water supply line (hot, cold and tempered) for control by the proximity detector.

The proximity faucet of the present invention is adaptable in a combination faucet having a spray that extends from the spout portion. The spray is insertably supported by the neck and coupled to a flexible hose to accommodate removable attachment of the spray from the neck and maintain fluid delivery to the spray. The spray includes at least one fluid outlet that provides one or more of a jet stream, a shower spray, a pulse spray, a waterfall and any combination thereof.

The proximity faucet of the present invention is also adaptable as a filter faucet having selective automatic and manual modes and comprising at least a first spout and a second spout. Each spout has a fluid outlet at a free extent thereof and a base portion proximate a faucet support surface. Each base portion includes a sensor cover ring that rotates relative to a proximity detector disposed in said base portion and includes an eye that remains sufficiently open to permit emission of a signal from the proximity detector. A mixing valve is provided with an electronically controlled valve positioned downstream thereof. One of the spouts is in fluid communication with a filter that filters water from a cold water supply, and both spouts are coupled to an electronic controller. The controller includes two manifolds corresponding to one each of the spouts and delivering fluid to at least one spout upon detection of an object by said proximity detector. The mixing valve controls the flow rate of combined water to the spout that is not in communication with the filter.

Various other advantages and features of the present invention will become readily apparent from the following detailed description, and the inventive features will be particularly evident from the appended claims.

DETAILED DESCRIPTION OF THE PREFERRED EMBODIMENTS

Figure 1:
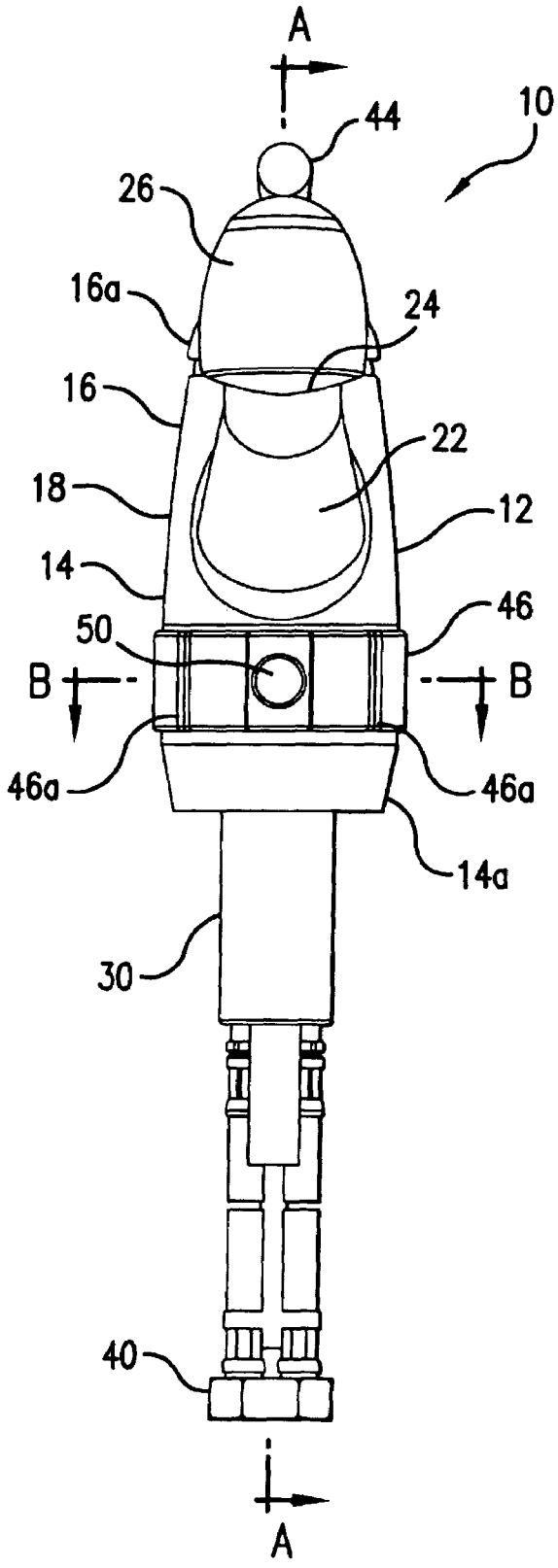
FIG. 1 is a front perspective view of a proximity faucet of the present invention shown as a combination faucet with spray and hose.

The proximity faucet of the present invention and preferred embodiments thereof are described with reference to the figures, wherein like reference numerals identify like elements.

Figure 2:
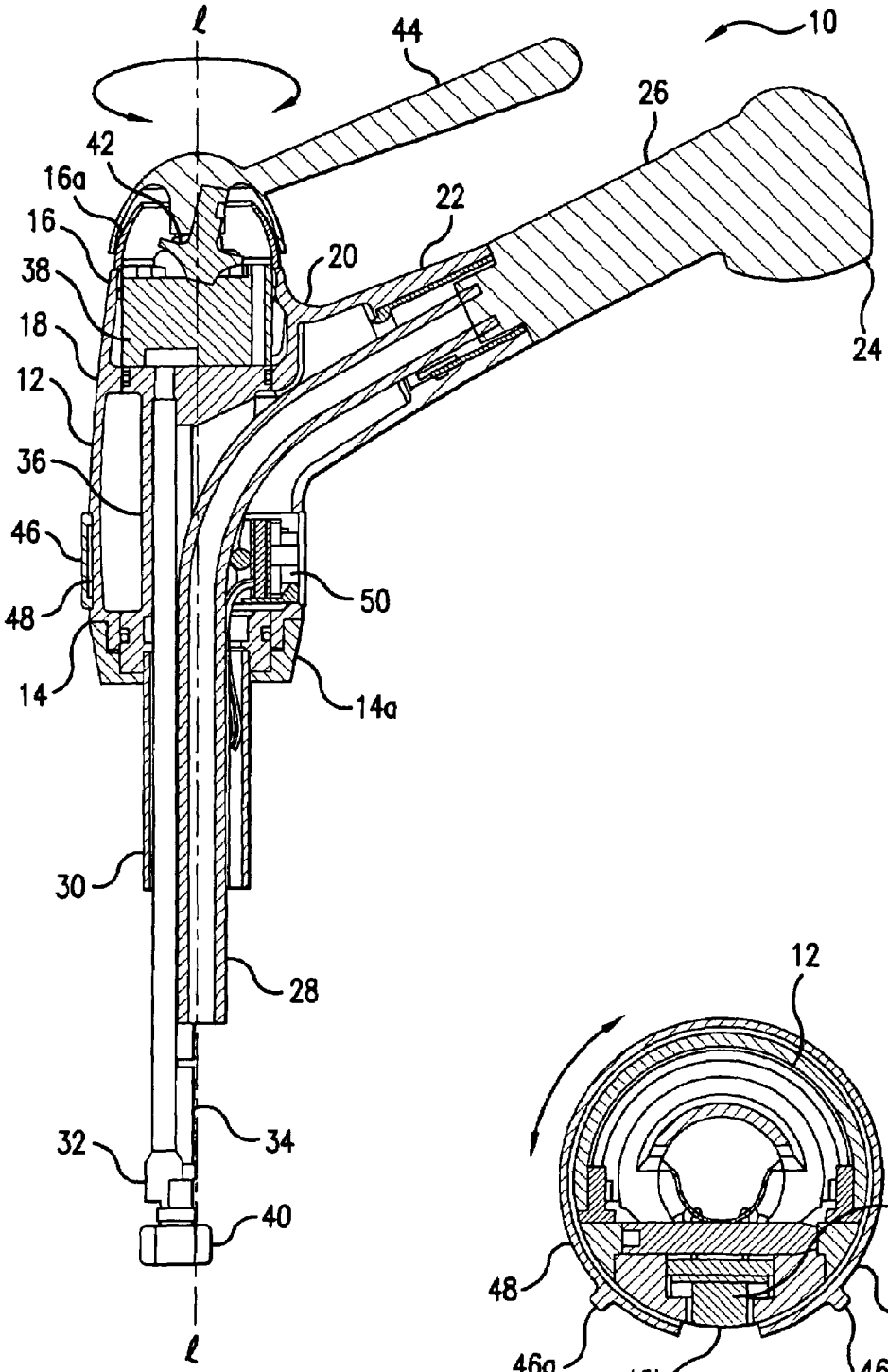
FIG. 2 is a cross-section of the fluid delivery device of FIG. 1 taken along line A-A.
Figure 3:
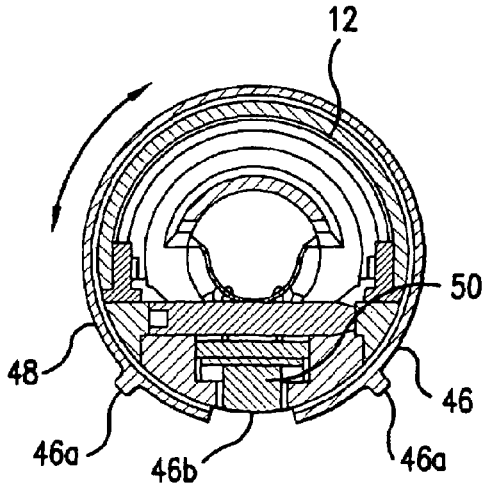
FIG. 3 is a cross-section of the fluid delivery device of FIG. 1 taken along line B-B.

Referring to FIGS. 1 to 3, a proximity faucet of the present invention is provided in the form of proximity combination faucet 10 having a housing 12. Housing 12 has a longitudinal axis l and includes a faucet support portion 14 having a spacer ring 14*a* thereat, a lever support portion 16 at a distalmost extent relative to faucet support portion 14 and a peripheral housing wall 18 that is coextensive with faucet support portion 14 and lever support portion 16. A spout portion 20 disposed intermediate faucet support portion 14 and lever support portion 16 includes neck 22 extending outward from housing wall 18 and having a fluid outlet 24 with at least one fluid aperture defined therein.

In the illustrated embodiment, neck 22 insertably supports a spray 26 thereby. Spray 26 is coupled to flexible hose 28 to accommodate removable attachment of spray 26 from neck 22 and simultaneously maintain fluid delivery to spray 26. Spray 26 has a fluid outlet (shown as fluid outlet 24) that includes at least one fluid aperture defined therein to provide one or more of a jet stream, a shower spray, a pulse spray, a waterfall, and any combination thereof or any other desired water flow pattern. One or more indicia may be provided along the longitudinal extent of spray 26 to accommodate gripping of the spray. Such indicia may further include one or more buttons to control the fluid volume and flow rate from spray 26 upon depression thereof. Such button control is well known in the art and does not form part of the present invention.

Although a combination faucet is shown, the present invention may be embodied in other types of sanitary fittings, including but not limited to kitchen and bathroom faucets, tub fillers, showers and any other sanitary device that is amenable to selective auto-manual operation as taught herein. Housing 12 is desirably fabricated from stainless steel, however, it is understood that housing 12 may be fabricated from any metal, plastic or any other material that is amenable to practice of the present invention.

Faucet support portion 14 is adapted for installation proximate a faucet support surface (not shown), such as an escutcheon or sink deck, and accommodates an elongate, generally cylindrical shank 30 extending downwardly therefrom. Shank 30 retains fluid supply conduits 32 and 34 therein that traverse a longitudinal extent of shank 30 and an internal body portion 36 of housing 12. Conduits 32 and 34 deliver hot and cold water, respectively, to a mixing cartridge 38 (described hereinbelow) and are desirably coupled to one or more fasteners such as threaded nut 40 to ensure uninterrupted fluid communication with at least one fluid delivery source.

Lever support portion 16, and particularly cartridge cover 16*a* thereof, receives mixing cartridge 38 therein having detent mechanism 42 assembled therewith. Cartridge 38 mixes cold and hot water delivered by conduits 32 and 34, respectively, in fluid communication therewith and also controls the flow rate of the mixed water from fluid outlet 24. Lever support portion 16 desirably supports a pivotable lever 44 on a free extent thereof that freely rotates about longitudinal axis l. Lever 44 is coupled with detent mechanism 42 such that rotation of lever 44 correspondingly adjusts detent mechanism 42 to change the water temperature and flow rate delivered by cartridge 38. Rotation of lever 44 about an axis perpendicular to axis l adjusts the flow rate of water from fluid outlet 24 and comprises a first degree of freedom for lever 44. Rotation of lever about axis l adjusts the temperature of the water from fluid outlet 24 and comprises a second degree of freedom for lever 44. The operation of cartridge 38 for dispensing cold, hot and mixed temperature fluids is well known in the art, and cartridge 38 may be selected from a plurality of known cartridge configurations such as those disclosed by Applicant's U.S. Pat. Nos. 6,070,611 (assigned to American Standard), 5,937,892 (assigned to Ideal Standard GmbH), which disclosures are incorporated by reference herein.

To enhance the faucet's performance, one or both of housing 12 and lever 44 may have one or more treatments applied thereon or integrated therewith during manufacture. Such treatments may have one or more of hydrophobic, hydrophilic, anti-microbial, antibacterial, biocidal, odor suppressing, anti-viral and algicidal properties. Such treatments are well known within the industry to promote the cleanliness of sanitary fittings and deter the transmission of undesirable contagions thereby. Such treatments are alternatively executed in the faucet material during manufacture A sensor cover ring 46 is rotatably disposed adjacent housing wall 18 and desirably includes one or more indicia 46*a* to facilitate rotatable adjustment of sensor cover ring 46 by a user and indicate the position of sensor cover ring relative to housing wall 18. Sensor cover ring 46 further includes a reflective surface 48 along an inner surface thereof that lies adjacent housing wall 18. Sensor cover ring 46 is advantageously positioned below neck 22 and rotates relative to a proximity detector 50 disposed in housing wall 18. Sensor cover ring 46 includes an eye 46*b* that enables proximity detector 50 to emit a signal upon alignment of eye 46*b* therewith. A user can therefore rotate sensor cover ring 46 about axis l as desired to selectively reveal proximity detector 50. Proximity detector 50 is desirably an infrared sensor that is well known in the art for touchless operation of fixtures and fittings. Proximity detector 50 may alternatively comprise radar, laser or any other detection means that is amenable to the successful practice of the present invention.

Housing 12, together with spout portion 20, may be rotatable about longitudinal axis l so as to enable positioning of faucet 10 relative to a basin, sink or other receptacle proximate which faucet 10 operates. Proximity detector 50 and sensor cover ring 46 correspondingly rotate about axis l as housing 12 rotates, although sensor cover ring 46 remains rotatable relative to housing wall 18. In this manner, proximity detector 50 defines a common, predictable detection zone 54 that follows the path of rotation of housing 12. In the alternative, proximity detector 50 and sensor cover ring 46 may be disposed alongside faucet 10 so that rotation of housing 12 does not alter the location of detection zone 54.

Figure 4:
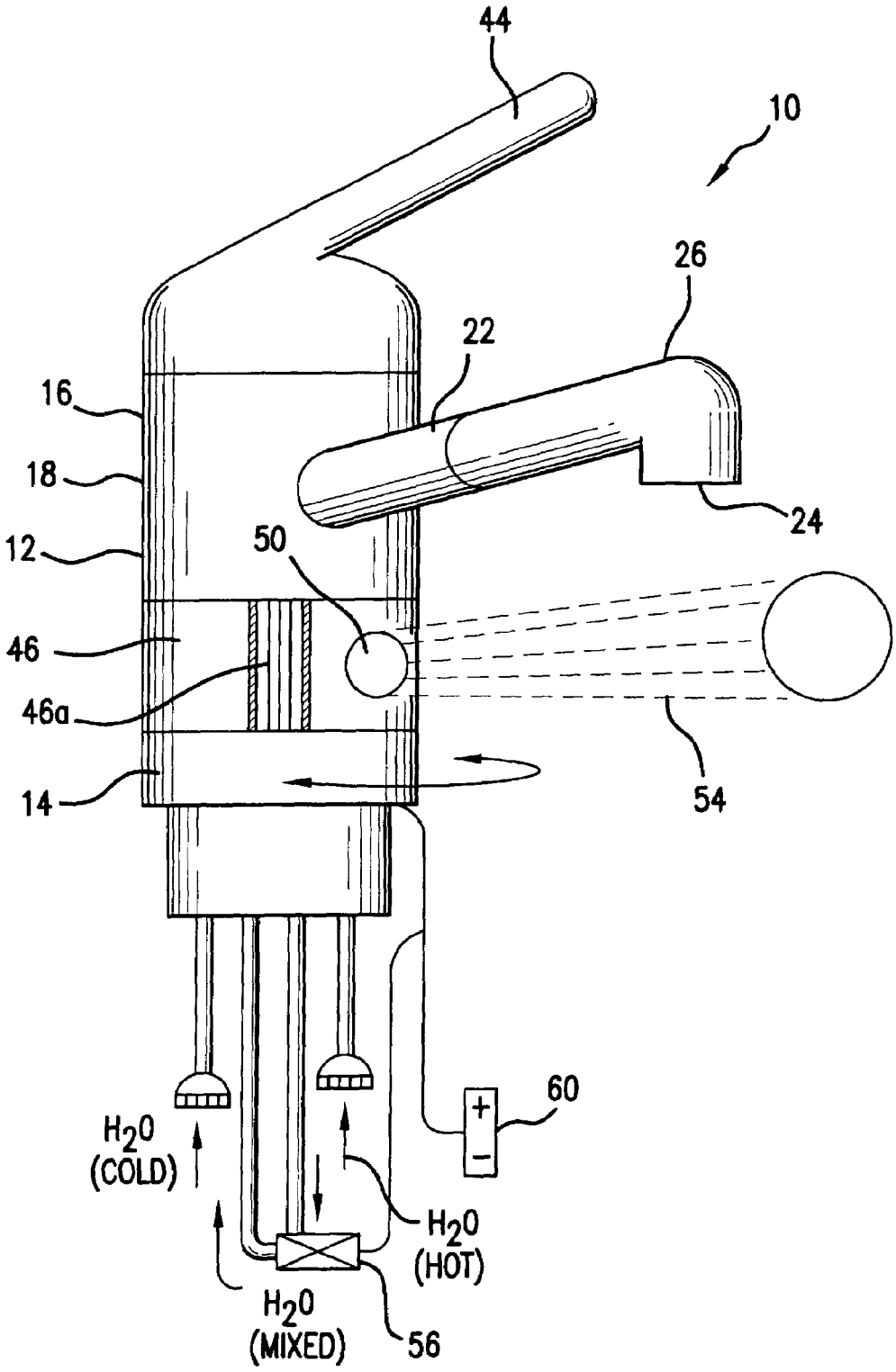
FIG. 4 is a schematic drawing of the fluid delivery device of the present invention coupled to a solenoid valve and having a proximity detector with a predefined detection zone.

As shown in FIG. 4, an electronically controlled valve such as solenoid valve 56 is positioned downstream of cartridge 38 and receives signals from proximity detector 50 upon detection of a user in detection zone 54. Proximity detector 50 continues to transmit signals to solenoid valve upon sensing the presence of a user in the detection zone or upon concealment of proximity detector 50 by sensor cover ring 46. In the latter instance, proximity detector detects its own signal as reflective surface 48 delivers the signal back to proximity detector 50, thereby maintaining cartridge 38 in an open position to define the manual mode. In this mode, lever 44 is manually manipulatable to acquire water from fluid outlet 24 having the desired temperature, volume and flow rate. Using lever 44 in this mode, a user can adjust cartridge 38 prior to using faucet 10 in the automatic mode (described hereinbelow) to thereby ensure that water having the desired characteristics repeatedly and predictably flows from fluid outlet 24. Manual adjustment of cartridge 38 provides partial water flow to spout portion 20 prior to revealing proximity detector 50, thus enabling fluid outlet 24 spray to instantaneously deliver the desired water flow upon revealing proximity detector 50. Although a single manual valve is shown in combination with a single solenoid valve, it is understood that additional valves may be employed as required in larger installations without departing from the scope of this invention.

Solenoid valve 56 and proximity detector 50 derive electrical power from a common power source such as battery pack 60 shown in FIG. 4. In the alternative, power may be supplied through an available AC current supply.

In operation, a user has the option to use proximity faucet 10 in a fully automatic mode or a fully manual mode as desired. For operation in the automatic mode, a user lifts and rotates lever 44 in one or two degrees of freedom, thereby manually manipulating valve cartridge 38 to derive the desired fluid temperature, volume and flow rate from fluid outlet 24. The user then grips indicia 46*a* and rotates sensor cover ring 46 relative to housing wall 18 so that eye 46*b* aligns with proximity detector 50. In this position, proximity detector 50 emits a signal for detection of an object (such as a user's hand) within detection zone 54. Upon entry of the user's hand in the detection zone, proximity detector 50 transmits a signal to solenoid valve 56 to deliver fluid having the selected characteristics. Water flows continuously so long as proximity detector 50 senses an object in detection zone 54. Upon removal of the object from the detection zone, fluid flow discontinues, however, cartridge 38 remains in its pre-selected position so that water having the selected characteristics will flow from fluid outlet 24 every time an object enters detection zone 54. Proximity detector 50 may be selectively programmed so that water flow discontinues upon satisfaction of one or more predetermined conditions, such as the lapse of a predetermined temporal duration, the dispensation of a predetermined fluid volume or any other parameter conducive to achieving an automatic shut-off function.

For operation in the manual mode, the user rotates sensor cover ring 46 relative to housing wall 18 until sensor cover ring 46 conceals proximity detector 50. The signal emitted by proximity detector 50 strikes reflective surface 48 and is reflected therefrom, thereby establishing a feedback loop to maintain cartridge 38 in an open position. In this mode, the user may rotate lever 44 in one or two degrees of freedom so as to manually acquire water having the desired temperature, volume and flow rate characteristics. The user can change these characteristics as required without incurring use of the proximity detector, thereby making this function useful in determining the desired water settings in the automatic mode. This configuration further provides an advantage over conventional automatic faucets in that reflective surface 48 prevents continuous water flow incurred by vandals upon tampering with the proximity detector.

Figure 5:
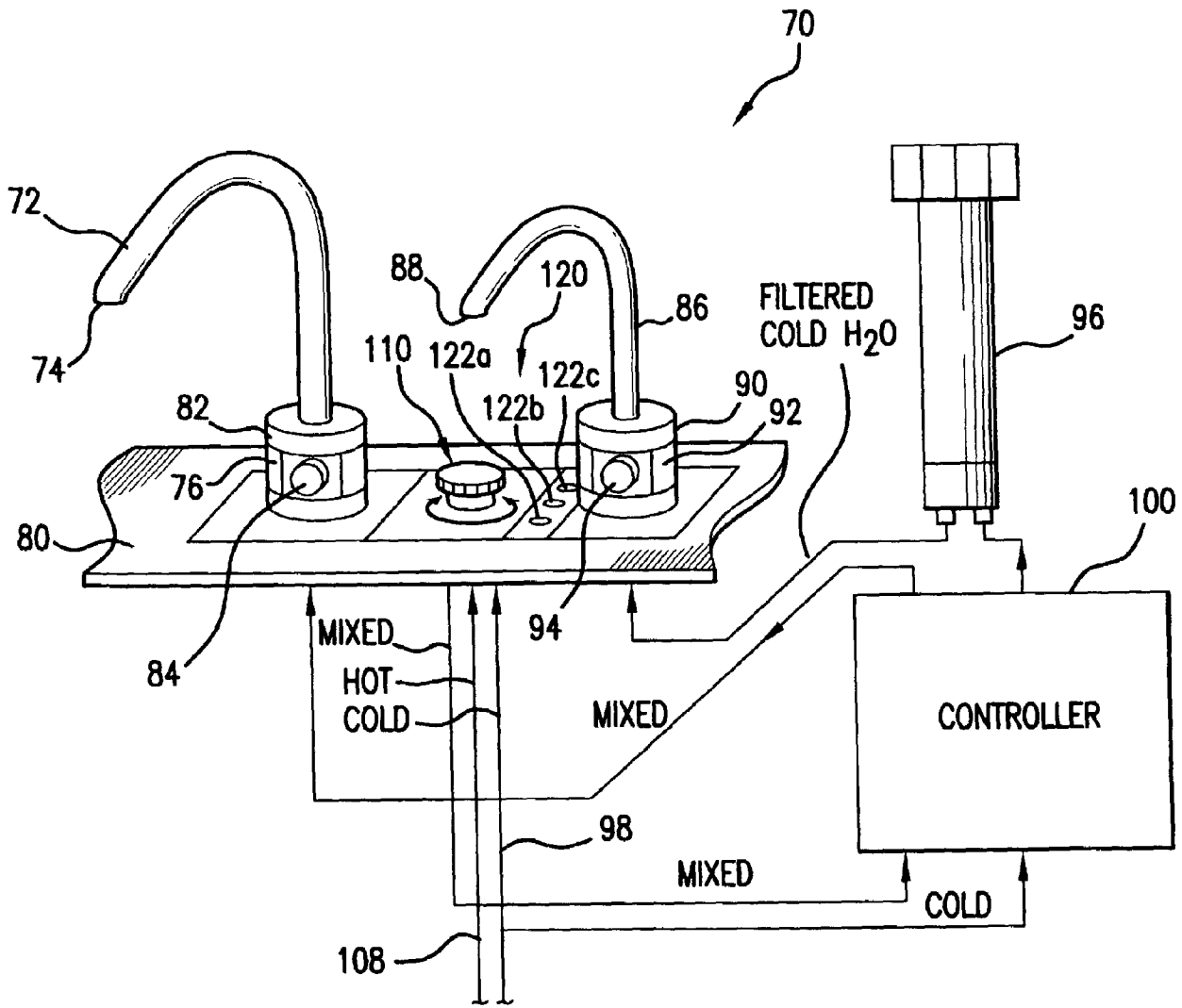
FIG. 5 is schematic drawing of the fluid delivery device of the present invention embodied in a filter faucet.

Now referring to FIG. 5, an alternative embodiment of the present invention is illustrated in the form of a filter faucet 70. Filter faucet 70 includes first spout 72 having a fluid outlet 74 at a free extent thereof and a base portion 76 proximate a faucet support surface 80. Base portion 76 includes a sensor cover ring 82 and a proximity detector 84 that operate much like sensor cover ring 46 and proximity detector 50 described hereinabove. A second spout 86 is also provided with a fluid outlet 88 and a base portion 90 having a sensor cover ring 92 and a proximity detector 94 that functions like sensor cover ring 46 and proximity detector 50 described hereinabove. Second spout 86 is in fluid communication with a filter 96 that filters water from cold water supply 98. Both first spout 72 and second spout 86 are coupled to electronic controller 100 that receives power from a resident AC supply. Controller 100 includes two manifolds corresponding to each of spouts 72 and 86 and which deliver fluid to said spouts upon detection of an object by a corresponding proximity detector 84 or 94. Filter faucets are well known in the art as taught by Applicant in U.S. Pat. Nos. 5,919,363, 5,993,648, 5,997,734 and 6,641,727, the disclosures of which are incorporated herein by reference.

A mixing valve is provided that combines cold and hot water delivered by cold water supply 98 and hot water supply 108, respectively. The mixing valve is operatively coupled to rotatable knob 110 such that rotation of the knob adjusts the temperature, volume and flow rate of water delivered from first spout 72 that is not in fluid communication with filter 96. A user may adjust the fluid temperature prior to using first spout 72 in the automatic mode so that water having the desired characteristics immediately flows from fluid outlet 74 upon detection of an object by proximity detector 84. It is understood that mixing valve may be disposed along any portion of faucet support surface 80 that is amenable to practice of the present invention.

Filter faucet 70 desirably includes indicator array 120 that indicates the operational status of filter faucet 70 or any other predefined condition thereof. In FIG. 5, a plurality of individual LED indicators 122 is provided wherein each indicator 122 illuminates when the predetermined condition is detected. As an example, a first indicator 122*a* may illuminate with a green light to indicate that filter 96 is fully operational and its lifetime extends beyond 30 days. A second LED indicator 122*b* may illuminate with an orange light to indicate that the lifetime of filter 96 is less than 30 days, suggesting that filter 96 should be replaced. A third LED indicator 122*c* may illuminate with a red light to indicate that the lifetime of filter 96 has expired and second spout 86 is currently delivering impure water. It is understood that indicator array 120 is not limited to three individual indicators as illustrated, and such indicators can indicate conditions such as water temperature, changing fluid pressure or any other condition that the user desires to monitor. This feature enhances the hygienic properties of the present invention by combining the benefits of a fully touchless automatic faucet with a mechanism to ensure that water is delivered in a clean, filtered state.

The present invention benefits users in diverse installations by substantially reducing the opportunities for cross contamination via faucet contact. For professionals where the risk of cross contamination is elevated, the present invention provides predictable and instantaneous water delivery of water having desired characteristics. Such an enhancement encourages such professionals to practice proper handwashing procedures with predictable comfort and within practical time constraints. The present invention also satisfies the need for easy selection between automatic and manual operation in commercial, professional and residential installations, wherein such selection satisfies the water delivery needs of several users in a single location.

Various changes to the foregoing described and shown structures are now evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A proximity faucet having selective automatic and manual modes, comprising:

a housing having a longitudinal axis and a faucet support portion, a lever support portion at a distalmost extent relative to said faucet support portion and a peripheral housing wall that is coextensive with said faucet support portion and said lever support portion; said faucet support portion adapted for installation proximate a faucet support surface and accommodating an elongate, generally cylindrical shank extending downwardly therefrom that retains at least one fluid supply conduit therein that traverses a longitudinal extent of said shank and an internal body portion of said housing; said lever support portion receiving a mixing cartridge having a detent mechanism in communication therewith, said mixing cartridge mixing cold and hot water delivered by said at least one fluid supply conduit in fluid communication therewith and also controlling the flow rate of said mixed water, said lever support portion supporting a freely rotatable lever thereon that rotates about said longitudinal axis and is coupled with said detent mechanism such that rotation of said lever correspondingly adjusts said detent mechanism to change water temperature and flow rate;

a spout portion disposed intermediate said faucet support portion and said lever support portion, said spout portion including a neck extending outward from said housing wall, said spout having a fluid outlet that includes at least one fluid aperture defined at a free extent thereof;

a sensor cover ring that is rotatably disposed adjacent said housing wall and includes a reflective surface along an inner surface thereof that lies adjacent said housing wall; said sensor cover ring rotating relative to a proximity detector disposed in said housing wall and including an eye that permits said proximity detector to emit a signal upon alignment of said eye therewith; and at least one electronically controlled valve positioned downstream of said mixing cartridge, said proximity detector transmitting detection signals to said electronically controlled valve upon sensing an object in a detection zone of said proximity detector or upon concealment of said proximity detector by said sensor cover ring, thereby maintaining said mixing cartridge in an open position;

wherein rotation of said sensor cover ring about said housing wall selectively reveals said proximity detector by aligning said eye with said proximity detector and thereby correspondingly selects said automatic and manual modes.

2. A proximity faucet according to claim 1, wherein said housing is rotatable about said longitudinal axis so as to enable positioning of said faucet relative to a receptacle proximate which said faucet operates.

3. A proximity faucet according to claim 2, wherein said proximity detector and said sensor cover ring rotate correspondingly with said housing such that said sensor cover ring remains rotatable relative to said housing wall to ensure said detection zone follows the path of rotation of said housing.

4. A proximity faucet according to claim 1, wherein said at least one fluid supply conduit is coupled to at least one fastener to ensure uninterrupted fluid communication with at least one fluid delivery source.

5. A proximity faucet according to claim 1, wherein said sensor cover ring includes indicia to facilitate rotatable adjustment of said sensor cover ring by a user and indicate a location of said sensor cover ring relative to said housing wall.

6. A proximity faucet according to claim 1, wherein said proximity detector is selected from infrared, radar and laser detectors and any combination thereof.

7. A proximity faucet according to claim 1, wherein said faucet is a combination faucet having a spray that extends from said spout portion in connection with a flexible spray hose, said spray being insertably supported by said neck and coupled to a flexible hose to accommodate removable attachment of said spray from said neck and thereby maintain fluid delivery to said spray.

8. A proximity faucet according to claim 7, wherein said spray includes at least one fluid outlet that provides one or more of a jet stream, a shower spray, a pulse spray, a waterfall, and any combination thereof.

9. A proximity faucet according to claim 7, wherein said spray includes indicia along a longitudinal extent thereof to accommodate gripping of the spray.

10. A proximity faucet according to claim 9, wherein said indicia further include one or more buttons to control the fluid volume and flow rate from said spray upon depression thereof.

11. A proximity faucet according to claim 1, wherein a power source that supplies power to said electronically controlled valve and said proximity detector is selected from a battery pack and household AC supply.

12. A proximity filter faucet having selective automatic and manual modes, comprising:

at least a first spout and a second spout, each said spout having a fluid outlet at a free extent thereof and a base portion proximate a faucet support surface; each said base portion including a sensor cover ring rotatable about a periphery thereof, said sensor cover ring having a reflective surface along an inner surface thereof that lies adjacent said base portion periphery; said sensor cover ring rotating relative to a proximity detector disposed in said base portion; said sensor cover ring including an eye that permits said proximity detector to emit a signal upon alignment of said eye therewith;

a mixing valve that combines cold and hot water delivered by at least one fluid supply conduit in fluid communication therewith; and at least one electronically controlled valve positioned downstream of said mixing cartridge, said proximity detector transmitting detection signals to said electronically controlled valve upon sensing the presence of an object thereby or upon concealment of said proximity detector by said sensor cover ring, thereby maintaining said mixing cartridge in an open position;

wherein one of said first spout and said second spout is in fluid communication with a filter that filters water from a cold water supply;

wherein both said first spout and said second spout are coupled to an electronic controller that includes two manifolds corresponding to each of said spouts and which delivers fluid to at least one of said spouts upon detection of an object by one said proximity detector; and wherein said mixing valve controls the flow rate of said combined water to said fluid outlet of said spout that is not in communication with said filter.

13. A proximity faucet according to claim 12, wherein said mixing valve is coupled with a rotatable knob such that rotation of said knob adjusts the temperature of water delivered from said spout that is not in communication with said filter.

14. A proximity faucet according to claim 12, wherein said filter faucet desirably includes an indicator array for indicating the operational status of said filter faucet.

15. A proximity faucet according to claim 14, wherein said indicator array includes a plurality of individual LED indicators corresponding to each condition desired to be indicated with respect to said filter faucet.

* * * * *